US006318392B1

(12) United States Patent
Chen

(10) Patent No.: US 6,318,392 B1
(45) Date of Patent: Nov. 20, 2001

(54) SUPPORTIVE WALKER WITH SAFETY FEATURES

(76) Inventor: Scott Chen, 16F-2, No. 163, Sec. 1, Wan-Shou Rd., Kwei-Shan Hsiang, Taoyuan Hsien (TW)

( * ) Notice: Subject to any disclaimer, the term of this patent is extended or adjusted under 35 U.S.C. 154(b) by 0 days.

(21) Appl. No.: 09/478,360

(22) Filed: Jan. 6, 2000

(51) Int. Cl.[7] ..... A61H 3/04

(52) U.S. Cl. ..... 135/67; 135/66; 135/85; 280/642; 280/647; 280/87.021; 280/47.27; 280/47.35; 482/66

(58) Field of Search ..... 135/65, 66, 67, 135/74, 76; 280/87.021, 47.35, 47.27, 642, 647, 648, 87.041; 297/188.12, 5; 482/66–68

(56) References Cited

U.S. PATENT DOCUMENTS 2,855,024 * 10/1958 Robb ..... 135/67
4,341,381 * 7/1982 Norberg ..... 135/67 X
4,641,844 * 2/1987 Mar et al. ..... 280/643 X
5,409,028 * 4/1995 Lee ..... 135/66
5,538,268 * 7/1996 Miller ..... 280/87.041 X
5,716,063 * 2/1998 Doyle et al. ..... 135/67 X
5,816,593 * 10/1998 Che ..... 280/87.041
5,878,625 * 3/1999 Hu ..... 74/502.2
5,887,887 * 3/1999 Keuning ..... 280/641

FOREIGN PATENT DOCUMENTS

WO 85/05268 * 12/1985 (WO) ..... 135/67

* cited by examiner

*Primary Examiner*—Winnie G. Yip
(74) *Attorney, Agent, or Firm*—Bacon & Thomas PLLC

(57) ABSTRACT

A supportive walker includes a front frame, a rear frame with a connection bar connected thereto and a pair of retaining frames connected to the front frame so that the connection bar extends through the two passages of the two retaining frames. A safety device has an engaging portion and an urging device which is biased between the retaining frame and the engaging portion. The engaging portion is releasably engaged with the connection bar by operating the urging device. Therefore, the front frame and the rear frame are expanded or folded securely when the urging device is released. The connection bar of the rear frame is movable in the passages of the retaining frames when the urging device is pressed.

4 Claims, 5 Drawing Sheets

SUPPORTIVE WALKER WITH SAFETY FEATURES

BACKGROUND OF THE INVENTION

1. Field of the Invention

The present invention relates to a supportive walker for disable persons, and more particularly, to an improved supportive walker having a safety means to easily control a connection bar connected to the rear frame so as to extend or fold the walker.

2. Description of the Related Art

A conventional supportive walker 90 is illustrated in FIG. 1 and generally includes a front frame 91 and a rear frame 92 which is connected to the front frame 91 by pivots. Both the front frame 91 and the rear frame 92 have wheels 95 connected to lower ends thereof. A limitation plate 93, such as a link 931 in this embodiment, is connected between the front frame 91 and the rear frame 92 so that the rear frame 92 can be expanded away from the front frame 91 or can be folded close to the front frame 91. In an expansion status of the supportive walker 90, a safety buckle 94 is connected between the front frame 91 and the rear frame 92 so as to ensure the fixed position of the front frame 91 and the rear frame 92. The safety buckle 94 includes a slot 941 defined in the rear frame 92 and a connection plate 942. The connection plate 942 has one end thereof connected to the link 931 and the other end of the connection plate 942 is engaged with the slot 941 so as to prevent the rear frame 92 from collapsing. Nevertheless, when the supportive walker 90 is moved on a rugged road, the connection plate 942 tends to be disengaged from the slot 941 and this could result in an accident. Furthermore, the location of the connection plate 942 is not convenient for the user to operate, especially for the users who are disable persons.

The present invention intends to provide a safety means of a supportive walker wherein the operation of the safety means is easy and convenient for the disable persons.

SUMMARY OF THE INVENTION

An objective of the present invention is to provide an improved and secure supportive walker that has simple structure and a good feature in maintaining an expansion status of the supportive walker.

Another objective of the present invention is to provide an improved supportive walker which is convenient for the users to fold or expand the walker.

In accordance with one aspect of the present invention, there is provided a supportive walker that can be expanded at a ready-to-be-used status, or can be folded at a storage status. The walker includes a front frame and a rear frame having wheels connected thereto. The front frame has a retaining frame with a passage. The rear frame connects with a connection bar capable of sliding in the passage of the retaining frame. Therefore, the front frame and the rear frame can be expanded and folded with each other. A safety means controls the movement and stops the sliding of the connection bar in the passage of the retaining frame to maintain the walker in a usage status, or allow the walker to be folded.

These and further objects, features and advantages of the present invention will become more obvious from the following description when combined with the accompanying drawings which show, for purposes of illustration only, several embodiments in accordance with the present invention.

DETAILED DESCRIPTION OF THE PREFERRED EMBODIMENT

Figure 1:
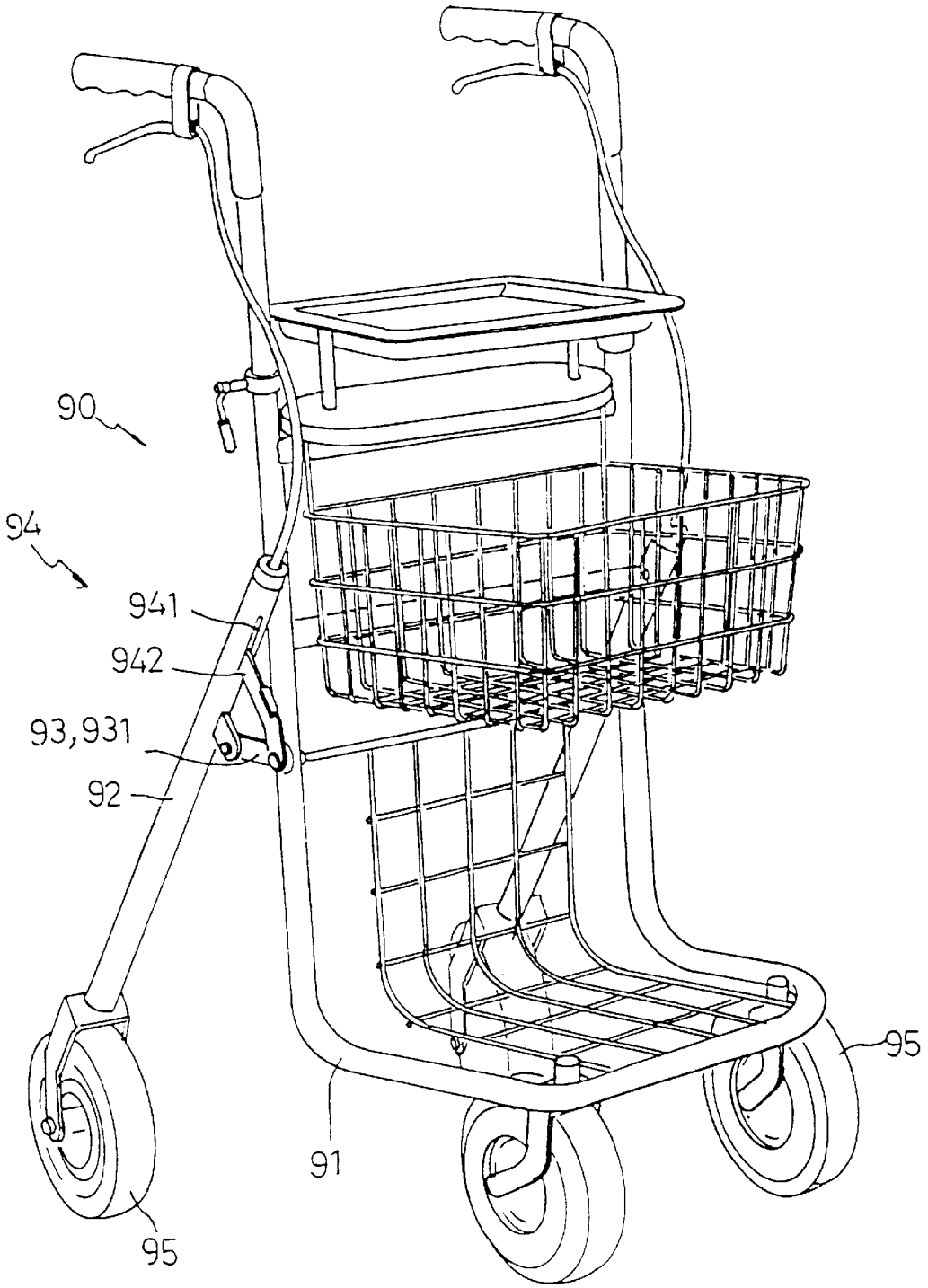
Fig. 1 (Prior Art)
FIG. 1 is a perspective view to show a conventional supportive walker.
Figure 2:
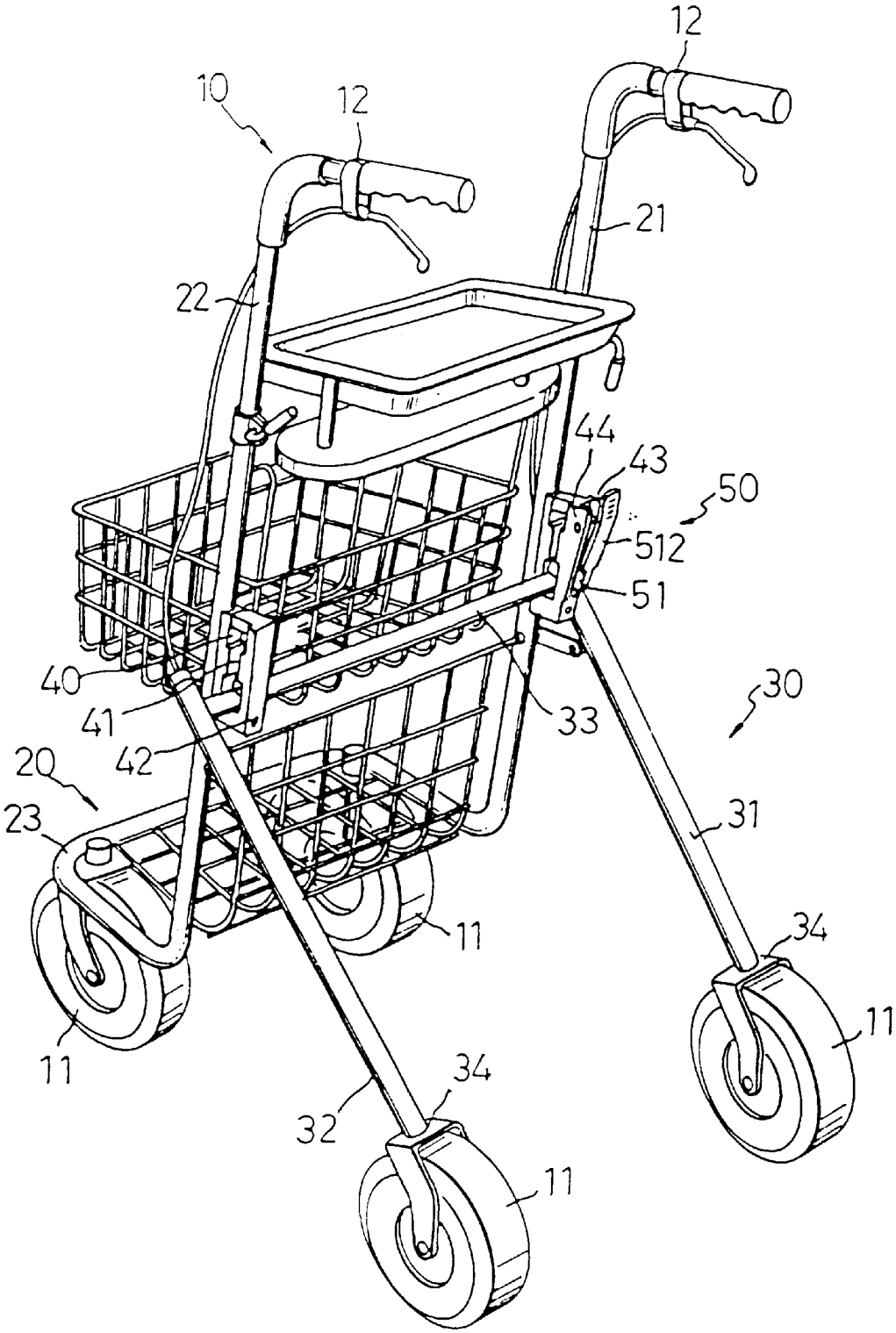
FIG. 2 is a perspective view to show a supportive walker in accordance with the present invention.
Figure 3:
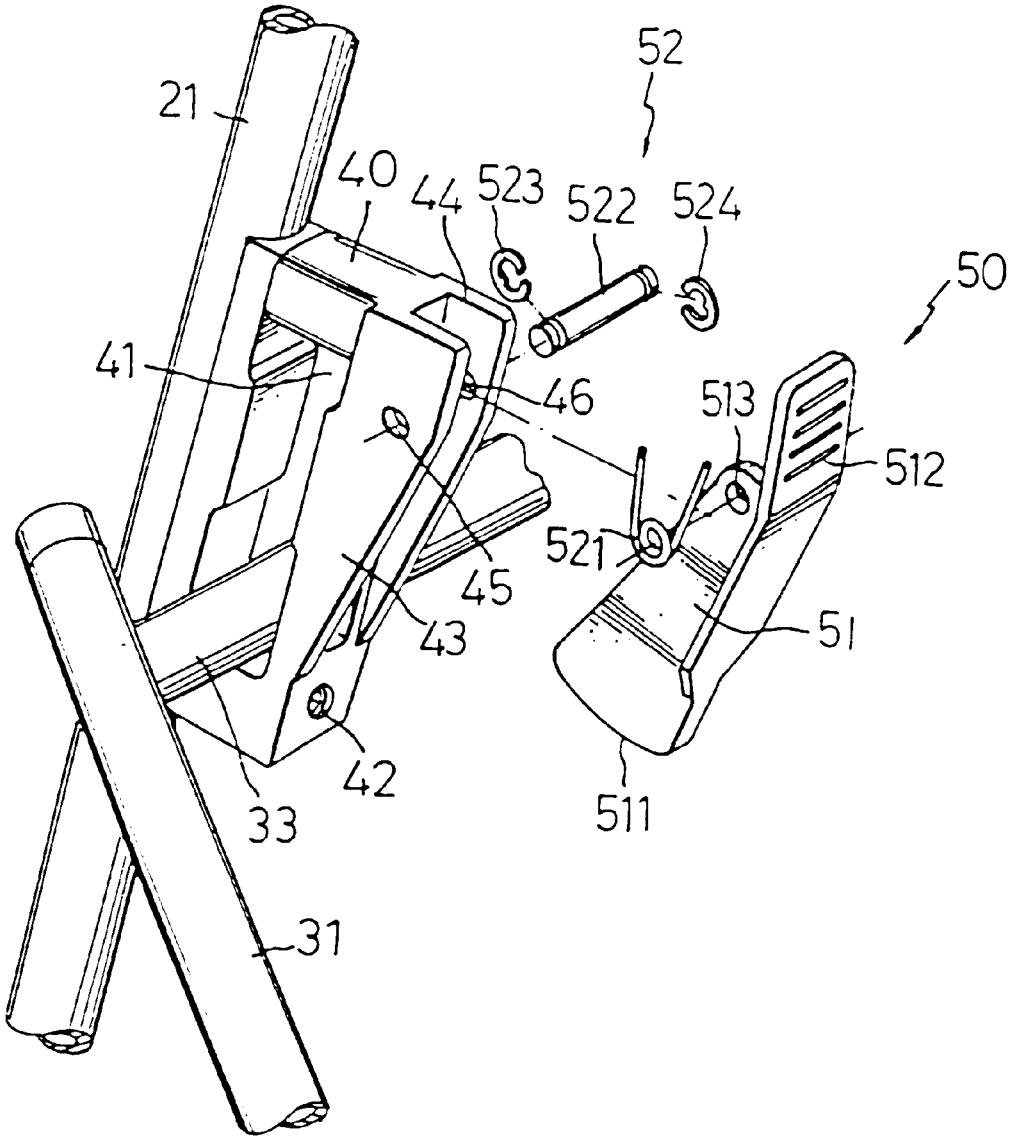
FIG. 3 is an exploded view to show the safety means of the supportive walker of the present invention.

Referring to FIGS. 2 and 3, a supportive walker 10 in accordance with the present invention comprises a front frame 20, a rear frame 30 with a connection bar 33 connecting two sides 31, 32 of the rear frame 30 and a pair of retaining frames 40 which are respectively connected to two sides 21, 22 of the front frame 20 by a locking member 42. The front frame 20 has wheels 11 connected to lower ends 23 thereof and each of the rear frame 30 has wheels 11 connected to lower ends 34 thereof. The front frame 20 may be equipped with only one wheel 11. Two brake devices 12 are respectively connected to two respective tops of the two sides 21, 22 of the front frame 20.

As shown in FIG. 3, in order to be conveniently stored or carried by the user, the supportive walker 10 equipped with the two retaining frames 40 and a safety means 50 so as to be expanded or folded.

The two retaining frames 40 may be made with the two sides 21, 22 as a one-piece member. Each of the retaining frames 40 has a passage 41 defined therethrough so that the connection bar 33 can slide in the two passages 41 of the two retaining frames 40.

One of the two retaining frames 40 has two wings 43, 44 and two holes 45, 46 are respectively defined through the two wings 43, 44. Once the other retaining frame 40 also connected with the safety means 50 should have such wings 43, 44 and holes 45, 46.

The safety means 50 includes an engaging portion 51 and an urging device 52. The engaging portion 51 has an aperture 513 and an operation end 512 extending therefrom so that the user may push the operation end 512. The urging device 52 is biased between the retaining frame 40 and the engaging portion 51. The urging device 52 includes a resilient member 521 and a pin 522 which extends two holes 45, 46 of the two wings 43, 44 and the aperture 513 of the engaging portion 51. The engaging portion 51 is located between the two wings 43, 44. Two fixing members 523, 524 are respectively engaged with two ends of the pin 522 so that the pin 522 will not drop from the wings 43, 44.

Figure 4:
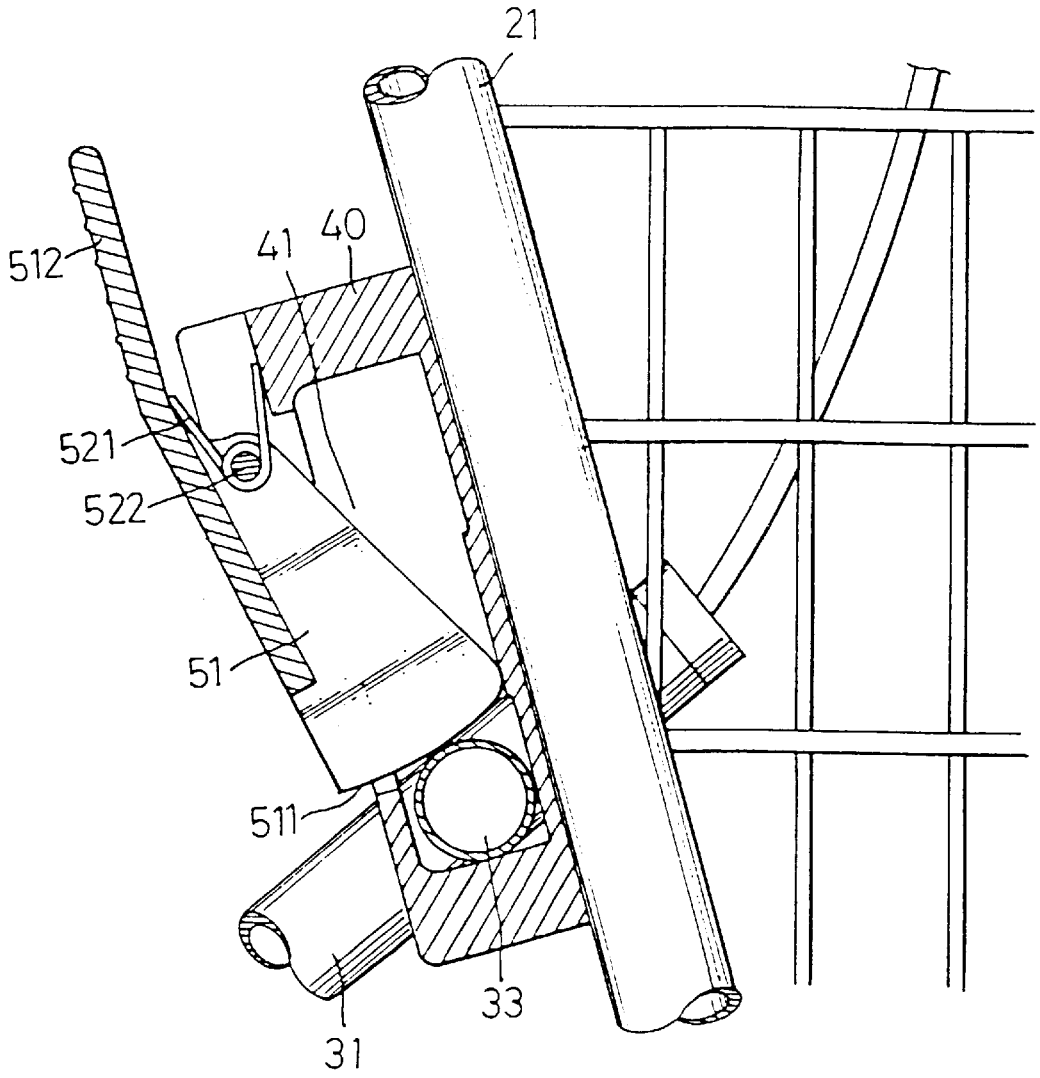
FIG. 4 is an illustrative view to show the safety means when the supportive walker is expanded.
Figure 5:
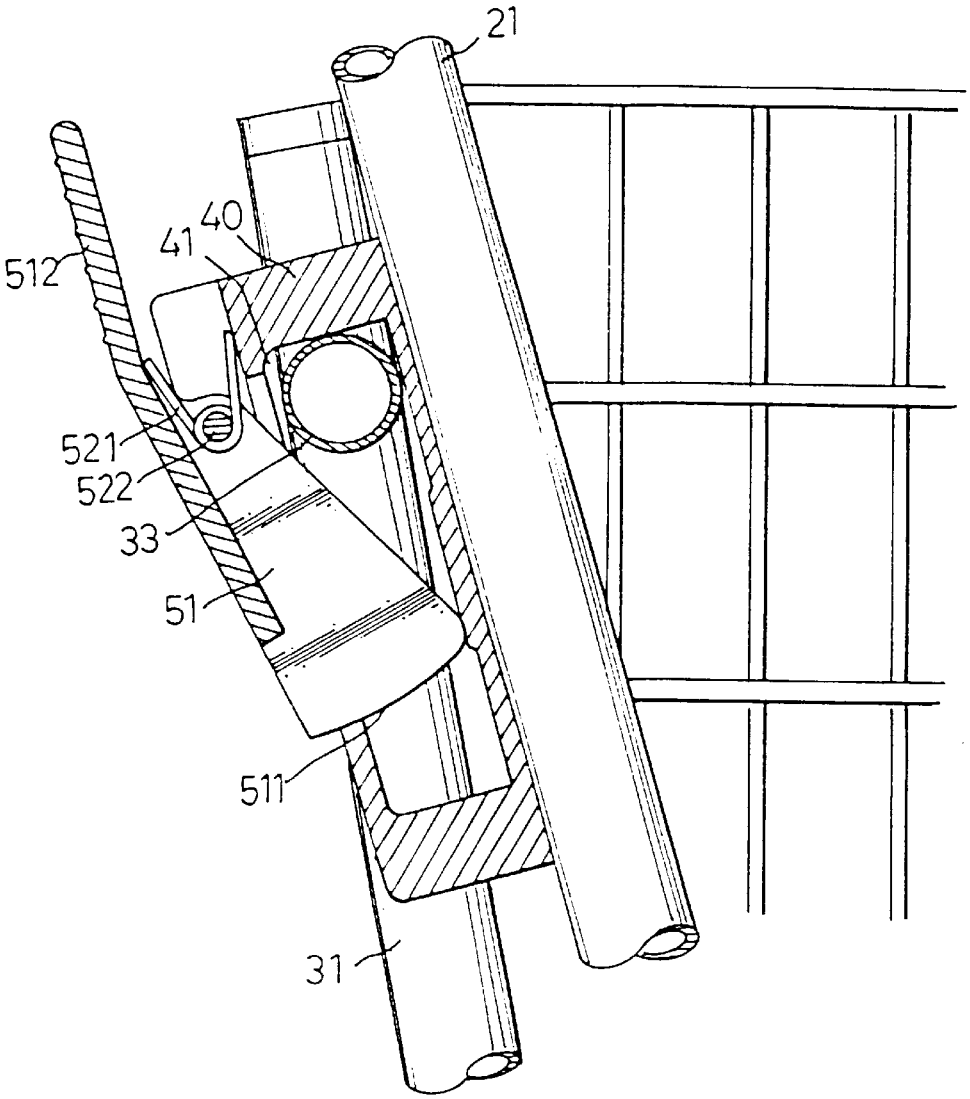
FIG. 5 is an illustrative view to show the safety means when the supportive walker is folded.

Please referring to FIGS. 4 and 5, because the engaging portion 51 can be moved by pushing the operation end 512 and compressing the resilient member 521 so that the engaging portion 51 is releasably engaged with the connection bar 33.

When the supportive walker is to be expanded, the user pushes the operation end 512 and compresses the resilient member 521 to remove a lower edge 511 of the engaging portion 51 from the passage 41. The connection bar 33 is then moved to the bottom defining the passage 41 as shown in FIG. 4. The operation end 512 is then released and the engaging portion 51 returns and presses onto the connection bar 33 because of the force of the resilient member 521 so that the connection bar 33 will be secured in the passage 41.

When the supportive walker is to be folded, the user pushes the operation end 512 to let the lower edge 511 of the engaging portion 51 remove from the passage 41. The connection bar 33 is then moved upward to the top defining the passage 41 as shown in FIG. 5. The operation end 512 is then released, the engaging portion 51 returns and the connection bar 33 is retained at the mentioned position.

While we have shown and described various embodiments in accordance with the present invention, it should be clear to those skilled in the art that further embodiments, for example, increasing a connection part between the front frame and the rear frame, revising connecting mechanism between the retraining frame and the front frame, additionally equipping a safety means or renewing the out feature of the engaging portion, without departing from the scope and spirit of the present invention.

What is claimed is:

1. A supportive walker comprising:

a front frame having a lower end, left and right sides;

a rear frame having a lower end;

wheels connected to respective ones of the lower ends of the front and rear frames;

a pair of retaining frames each connected to a respective one of the left and right sides of the front frame, each one of the retaining frames having a passage defined therethrough;

a connection bar connected to the left and right sides of the rear frame, the connection bar slidingly positioned in each of the passages of the retaining frames;

at least one safety device being pivotally connected to at least one of the retaining frames, the safety device comprising an engaging portion and an urging device biased between the at least one of the retaining frames and the engaging portion, the engaging portion pivotally connected outside the passage of the at least one of the retaining frames;

when the connection bar is engaged by the engaging portion at the lower end of the passage of the at least one of the retaining frames, the front frame and the rear frame are unfolded and secured; and when the connection bar is disengaged by the engaging portion and the connection bar is moved toward the upper end of the passage of the at least one of retaining frames, the front frame and the rear frame is movable to be folded.

2. The walker according to claim 1, wherein said urging device comprises a resilient member and a pin.

3. The walker according to claim 1, wherein the safety device comprises an operation end extending from the engaging portion, such that a user may push the operation end to secure or release the connection bar.

4. The walker according to claim 1, wherein said retaining frame is secured to the front frame by a locking member.

* * * * *